United States Patent [19]

Ebert

[11] 4,125,304

[45] Nov. 14, 1978

[54] COLLAPSIBLE CUPBOARD

[75] Inventor: Claus Ebert, Kronberg, Germany

[73] Assignee: ISOPOL A.G., Switzerland

[21] Appl. No.: 796,440

[22] Filed: May 12, 1977

[30] Foreign Application Priority Data

May 21, 1976 [CH] Switzerland ..... 6469/76

[51] Int. Cl.[2] ..... A47B 47/03

[52] U.S. Cl. ..... 312/257 SM; 16/162; 312/111

[58] Field of Search ..... 312/257 R, 257 SK, 257 SM, 312/263, 265, 257 A, 245, 199, 111; 16/167, 176, 147, 171, 162

[56] References Cited

U.S. PATENT DOCUMENTS

| | | | |
|---|---|---|---|
| 859,860 | 7/1907 | Weir | 312/320 |
| 1,944,394 | 1/1934 | Bales et al. | 312/263 |
| 3,065,035 | 11/1962 | Biesecker | 16/167 |
| 3,730,605 | 5/1973 | Eckard | 312/257 |
| 3,748,009 | 7/1973 | Stone | 312/111 |
| 3,784,271 | 1/1974 | Schreiber | 312/245 |
| 3,837,721 | 9/1974 | Manlove et al. | 312/257 R |
| 3,918,781 | 4/1975 | Paris | 312/111 |
| 3,972,550 | 8/1976 | Boughton et al. | 312/138 R |

FOREIGN PATENT DOCUMENTS

| | | | |
|---|---|---|---|
| 1,933,183 | 5/1970 | Fed. Rep. of Germany | 312/263 |
| 509,714 | 1/1955 | Italy | 312/257 SK |

*Primary Examiner*—Mervin Stein
*Assistant Examiner*—Alex Grosz
*Attorney, Agent, or Firm*—Robert E. Burns; Emmanuel J. Lobato; Bruce L. Adams

[57] ABSTRACT

A collapsible cupboard or cabinet, for the storage of tools and household implements, which can be made available in kit form. Such cabinet comprises a rear wall provided on its front top and bottom edges with at least one horizontal groove; two horizontal shelves or plates which are provided with means for fastening said plates to the rear wall, for instance in the form of profiled edges which can be detachably inserted in said grooves; and two sidewalls which can be attached thereto at right angles from the outside on each side and which can be detachably fastened at least along their top and bottom edges to the narrow sides of the shelves. The sidewalls have recesses at their front vertical edges for detachably receiving hinge elements to which leaves of the door can be detachably fastened.

10 Claims, 1 Drawing Figure

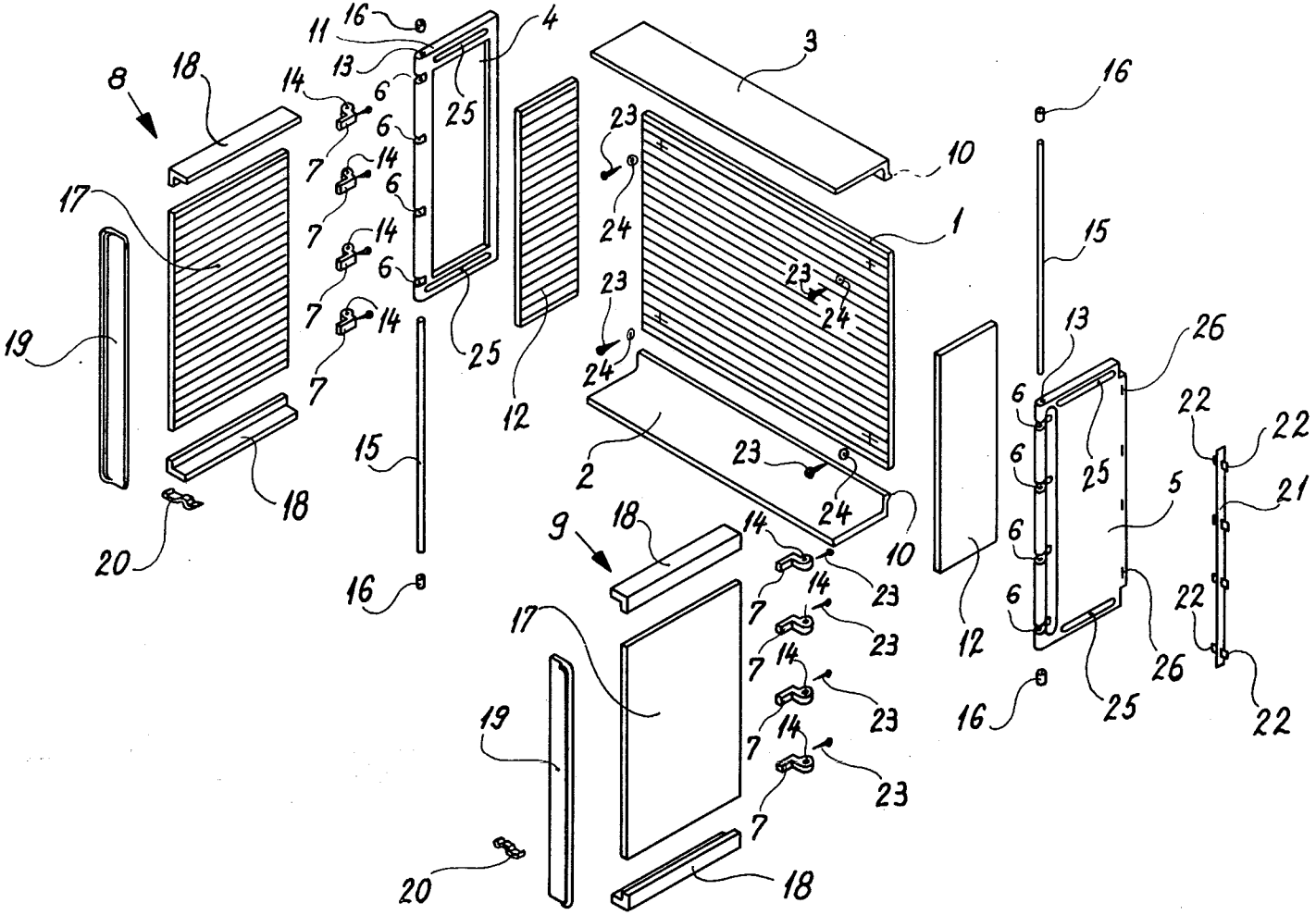
1
2
3
4
5
6
7
8
9
10
11
12
13
14
15
16
17
18
19
20
21
22
23
24
25
26

COLLAPSIBLE CUPBOARD

BACKGROUND OF THE INVENTION

The invention refers to a collapsible cupboard for storage of tools, utensils, containers or the like.

For such purposes above all cupboard walls are known of sheet steel, wooden and hardboard panels, which are delivered, stored and shipped in the ready assembled state. Moreover the supporting devices for the objects to be stored, for example, for tools, either in the case of sheet steel cupboards are spotwelded solidly to the cupboard or in the case of wooden and hardboard panel cupboards are glued to it. But as a result the external dimensions of such a cupboard as well as the supports fitted in such a cupboard for receiving tools and the like are unalterably fixed. The fixed internal arrangement makes another use or another set of fittings impossible.

The purpose of the invention is therefore the creation of a cupboard for the possible uses mentioned above, which is easy to assemble and dismantle so that while not in use it may be stored and shipped in the dismantled state and then when needed can be put together by the user in a simple manner without special tools or other accessories.

SUMMARY OF THE INVENTION

A cupboard of this kind is for this purpose in accordance with the invention characterized by a rear wall provided on its front face along its top and bottom edges with at least one horizontal groove each and two horizontal shelves which can be inserted detachably in these horizontal grooves by a correspondingly profiled edge as the bottom and the top, as well as by two sidewalls which can be attached to it at right angles from the outside on each side and are fastened detachably at least along their top and bottom edges to the narrow sides of the shelves, the sidewalls having recesses at their front vertical edges for detachably receiving hinge elements to which leaves of the door can be detachably fastened.

Beside the ease of putting together and dismantling such a cupboard, for which at most a screwdriver is necessary, there is further the advantage that most of the individual parts of constant dimensions may be produced in large batches from suitable plastics materials, which keeps the production costs relatively low and affords the user the possibility that once a cupboard has been acquired and installed it can be extended or completed by the building-on of further like parts after the style of building-bricks. The relatively small number of different elements to be kept in stock for this purpose facilitates supervision and holding of stock very advantageously.

Through the possibility of transporting, storing and delivering such a cupboard in the dismantled state, in comparison with ready-assembled cupboards of this kind up to 70% of the shipping and storage space can be saved, which simplifies the handling of the cupboard when not in use exceedingly.

BRIEF DESCRIPTION OF THE DRAWINGS

In the attached drawing a single FIGURE is presented, wherein for the sake of example an embodiment of a cupboard made in accordance with the invention is illustrated in the exploded state of its individual parts.

DESCRIPTION OF THE PREFERRED EMBODIMENT

This cupboard has first of all a rear wall 1 which advantageously consists of a machinable, in particular drillable material, for example, of an extruded structural plastics foam, and can be fastened to a wall by means of screws 23 and washers 24. This rear wall 1 is provided in its front, as shown, and particularly along its top and bottom transverse edges, with horizontal grooves 10-X, the sectional profile of which preferably widens inwards, for example, in a dovetail or T-shape. Into these horizontal grooves may be inserted horizontal shelves 2 and 3 having a correspondingly profiled edge. Of these shelves which may consist simply of profiled section of the same shape, the lower shelf 2 acts as the bottom of the cupboard and the upper shelf 3 as the top. The supporting devices for each shelf in the horizontal grooves in the rear wall 1 may, for example, consist of a rib or lug 10 on the outer rear face of a flange 2', 3' on one longitudinal edge of the shelf, which can be inserted detachably in a horizontal groove 10' near the top or bottom edge of in the rear wall. In that case it has for reasons of greater stability proved advantageous to provide in each case two parallel horizontal grooves along the top and bottom edges of the rear wall, in which the shelf can be inserted by lugs arranged in pairs one vertically above the other.

But for reasons of manufacturing technique it is advantageous to make the supporting devices for the shelves as a continuous rib 10 which is profiled to correspond with the horizontal grooves in the rear wall, on the outside at the rear of a longitudinal flange on the shelf, and can be inserted in one of the horizontal grooves. In that case too it may be advantageous for reasons of stability to provide in each case two parallel horizontal grooves along the top and bottom edges of the rear wall, into which the shelves can then be inserted by two ribs profiled to correspond with the horizontal grooves.

These supporting devices for the shelves in the form of lugs or ribs on the outside at the rear of a longitudinal flange on the shelf may either be at least partially elastically deformable so that they can be forced into the horizontal grooves in the rear wall 1 from the front, or else be made rigid so that they can be pushed from the edges of the rear wall at the sides into the horizontal grooves in it, which for this purpose are open at least at one end.

The sidewalls 4 and 5 of the cupboard are in the case of the embodiment illustrated likewise made the same and can be attached to the edges of the rear wall at the sides and the narrow sides of the shelves 2 and 3. In that case these sidewalls for a rigid connection are either screwed along their top and bottom horizontal edges to the narrow sides of the shelves and in case of necessity also to the edges of the rear wall at the sides, or else are provided with slots or grooves or similar recesses 25 along their top and bottom horizontal edges, in which the side edges of the shelves 2 and 3 engage. Grooves 25 of that kind may in that case be provided both on the inside and also on the outside of the sidewalls 4 and 5, in which case the outer recesses are used for receiving the side edges of shelves or directly adjoining cupboards which as extension cupboards extend or complete an already existing cupboard on both sides like building-bricks. Moreover in this case at least one sidewall of the built-on additional cupboards can be saved.

The sidewalls 4 and 5 themselves may consist of one piece or as in the case of the embodiment illustrated, of a rigid frame 11 and an insert 12 which can be inserted in the opening in the frame. The aforesaid recesses 25 for receiving the side edges of the shelves are then arranged in the top and bottom cross-spars of the frame as may be seen in the drawing. This latter form commends itself particularly when the inner faces of the sidewalls are to be provided with adjustable supporting devices for objects which are to be accommodated. These inserts may then be taken out on their own and the supporting devices fitted or altered without having to dismantle the whole cupboard.

In any case, whether these sidewalls are now produced from one piece or a number of pieces they have at their front vertical edges a number of recesses 6 for receiving detachable hinge elements 7 having hinge portions normally supporting the leaves 8 and 9 of the door. For supporting these hinges 7 to be detachable a hole 13 is drilled longitudinally to run parallel with the front vertical edge of the sidewall and is made continuous between the top and bottom cross edges of the sidewalls and moreover is aligned coaxially with the hinge-recesses so that it passes through these concentrically. A hinge rod 15, preferably of metal, can be inserted in this longitudinal hole 13. At the hinge elements 7 inserted in the recesses 6 this rod 15 passes at the same time through coaxial holes 14 drilled therein and thereby keeps these in their recesses. The rod 15 in this way at the same time forms pivot for the hinges, about which the elements 14 can pivot by means of their drilled holes 14. The hinge portions 7' are, as shown, tangential to the hinge elements 7.

For securing this hinge rod 15 the longitudinal hole 13 is closed off at both ends by means of insertable caps 16.

The leaves 8 and 9 of the door in the case of the embodiment illustrated consist of a number of moulded parts, that is, of the actual door panel 17 which is provided at the top and bottom horizontal edges with an edge fillet 18 at each and at its free vertical end with a handle-fillet 19. These edge and handle fillets 18 and 19 have preferably a rectangular cross-sectional profile. In the case of the edge fillets 18 an arm of the profile moreover projects inwards and thus if wide enough can be used also for supporting (the bottom one) or hanging up (the top one) small parts. But it is also possible to join at least the top and bottom edge fillets 18 in one piece onto the door panel 17 if, for example, the door leaf is produced by extrusion. By applying another method of moulding it may also be made possible to join the front handle-fillet 19 on in one piece so that then each leaf of the door consists of only one single moulded piece.

In order to keep the doors closed to avoid the entry of dust and moisture, in the case of the embodiment illustrated clips 20 are provided which consist simply of elastically springy blades which project from the inner face of the doors 8 and 9. These clips 20 are in that case advantageously arranged at the top or bottom end of the vertical handle-fillet 19 and with the doors closed engage behind correspondingly shaped lugs, not shown in the drawing, on the top and bottom shelves.

For locking the cupboard a lock is provided on the handle-fillet 19, which may be screwed on or inserted into corresponding grooves from the edge at one side.

The leaves 8 and 9 of the doors are supported by the straps of the hinge elements 7 supported pivotally in the recesses 6 in the sidewalls. In that case the connection is effected either by screws 23 which are screwed in through the straps of the respective hinges into the narrow side of the door panel 17, as is provided for in the case of the embodiment illustrated, or by simply forcing these hinge straps into correspondingly arranged and formed holes or grooves in the door panel.

But in any case these elements 7 are made so that their pivot hole 14 lies off centre from the plane of the door leaf and the hinge strap is arranged tangential to it. The purpose and advantage of this particular form of the hinges consists in the fact that the leaves of the doors after swinging out through 180° always lie in front of a vertical plane passing through the hingerod 15 and thereby do not collide with an adjoining built-on cupboard of the same form even if the leaf of its door is hinged onto the same front edge of the side wall by like hinges which are, however, twisted symmetrically. In this case a number of recesses 6 have to be provided, the hinges in which may then in each case be associated alternately with one or other door leaf.

For connection and mutual alignment of two adjoining built-on cupboards of the kind described above, which rest against one another by their own respective sidewalls, in the case of the embodiment illustrated a connector fillet 21 is provided, having studs 22 formed symmetrically in pairs opposite one another, which can be forced into correspondingly arranged and formed holes 26 on the outer face of the sidewalls 4 and 5.

Instead of the studs 22 at least one longitudinal rib may also be provided on two opposite sides of the connector fillet, which can be inserted in correspondingly arranged and formed grooves on the outer face of the sidewalls. These longitudinal ribs may also again be either elastically deformable and can be simply forced into grooves which in sectional profile widen inwards or else be made rigid and then be inserted into these grooves from the edge of the sidewall.

These connector fillets in one or other form are arranged both vertically as is the case with the embodiment illustrated, and also horizontally if this appears advantageous for some reason or other.

Also the application of a number of connector fillets, for example, along the rear and front or else along the top and bottom edges of the sidewall is possible and with higher loading also often indicated.

But if the loading of two adjoining built-on cupboards is only small the connector fillet may also be substituted by individual connector studs which then in turn can be forced into correspondingly arranged and formed holes 26 on the outer face of the sidewalls 4 and 5. These individual studs, too, are advantageously made symmetrical and exhibit like the studs 22 on the connector fillet 21 a slightly tapered shape in order to be able to force them into the holes 26 with a light grip.

Through the exceptional possibilities of employment of suitable, preferably foamed plastics for the manufacture of the parts of the cupboard in accordance with the invention no rust formation, no warping and no swelling of the material occur. No tearing out and no fraying follows from overloading as in the case of hardboard panels, in particular from the action of moisture.

By varnishing, UV stability may be achieved and static charging prevented. Also better resistance against oil and grease which possibly adhere to tools can be achieved by such surface treatment. It is again possible by means of stencils to apply symbols, figures, letters, outline drawings or pictures on the inside faces of the walls of the cupboard in order to facilitate allocation of places to the objects to be stored.

Of particular advantage, too, is the possibility of machining of material of that kind by drilling, sawing, naling, screwing, gluing, welding, so that the amateur craftsman can produce every possible combination and adaptation in departure from standard dimensions.

By suitable additives such as glass fibre, steel wool or the like to the material of manufacture the mechanical loading capacity of the cupboard may be considerably increased.

A further advantage of the cupboard made in accordance with the invention consists in the possibility of employment of so-called vertical drawers. These vertical drawers consist of preferably rectangular panels which hang by their top horizontal edge from extensible telescopic rails and are provided on both sides with supporting devices for objects to be stored. The telescopic rails are moreover attached to the underside of the top shelf 3 at right angles to the rear wall of the cupboard, for example, simply by screwing them on. Equipped in this way the cupboard only need to be made deeper to increase its storage capacity, so that merely wider sidewalls and shelves are employed, whilst all other parts may remain unaltered.

What is claimed is:

1. A collapsible cupboard for tools, utensils, containers and the like, comprising; a rear wall having a front face which has top and bottom edges, and having, disposed along each of the edges, a horizontal groove; two horizontal shelves, having edge portions extending therefrom and receivable detachably in the horizontal grooves to fully support the shelves; and sidewalls detachably attachable to the rear wall at right angles from the outside thereof and similarly attachable to the shelves, the sidewalls having recesses at front vertical edges thereof for detachably receiving hinge elements for leaves of a door; whereby the walls and shelves can be collapsed into a dismantled state, saving a substantial part of space which they occupy when attached to one another, and thereby simplifying their handling, shipping and storage.

2. A cupboard according to claim 1, in which the edge portions of the shelves are elastically deformable, whereby the shelves can be inserted from the front into the horizontal grooves.

3. A cupboard according to claim 1, wherein the edge portions of the shelves are rigid ribs which can be inserted into the horizontal grooves from lateral edges of the rear wall.

4. A cupboard according to claim 1, in which the sidewalls also have groove-shaped recesses disposed along top and bottom horizontal edges thereof on outer faces of the sidewalls for receiving side edge portions of shelves of adjoining built-on cupboards.

5. A cupboard according to claim 1, wherein each sidewall comprises a rigid frame, and an insert which can be detachably inserted in and attached to the frame.

6. A cupboard according to claim 1, also having an elongate fillet engageable with an outer face of one of the sidewalls for lateral connection and mutual alignment of another cupboard.

7. A cupboard according to claim 6, in which the connector fillet has several pairs of studs, the pairs being spaced apart along the connector fillet and each pair comprising two studs disposed symmetrically on opposite sides of the connector, for insertion in corresponding recesses in said outer faces.

8. A collapsible cupboard for tools, utensiles, containers and the like, comprising; a rear wall having a front face which has top and bottom edges, and having, along each of the edges, a horizontal groove; horizontal shelves having edge portions which can be detachably inserted in and attached to the horizontal grooves; sidewalls which can be detachably attached to the rear wall and to the shelves; door leaves; hinge elements for pivotable attachment of the door leaves to the sidewalls, each sidewall having hinge recesses in a front vertical edge thereof for detachably receiving one of the hinge elements in each hinge recess, each sidewall also having a longitudinally extending hinge hole parallel and adjacent to the respective front vertical edge; and a hinge rod insertable into each hole through a hole of the respective hinge elements to hold the latter in place, each hinge element also having a hinge portion disposed tangentially to the element, outside the plane of the respective sidewall, for attachment of the door leaf to the hinge portion.

9. A cupboard according to claim 8, also including a cap which can be inserted at an end of one of the hinge holes for closing the hold and retaining the hinge rod therein.

10. A cupboard according to claim 8, wherein each door leaf has an edge fillet at top and bottom edges thereof, and a handle fillet at a free vertical edge of the door leaf.

* * * * *